US009693411B1

(12) United States Patent
Xiong et al.

(10) Patent No.: US 9,693,411 B1
(45) **Date of Patent: *Jun. 27, 2017**

(54) LED DRIVER CONFIGURATION AND DIMMING INTERFACE FOR DYNAMIC ADJUSTMENT OF DRIVER OPERATING PARAMETERS

(71) Applicant: Universal Lighting Technologies, Inc., Madison, AL (US)

(72) Inventors: Wei Xiong, Madison, AL (US); Keith Davis, Madison, AL (US); Candice Ungacta, Huntsville, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/091,651

(22) Filed: Apr. 6, 2016

Related U.S. Application Data

(60) Provisional application No. 62/145,266, filed on Apr. 9, 2015.

(51) Int. Cl.
*H05B 33/08* (2006.01)

(52) U.S. Cl.
CPC ..... *H05B 33/0845* (2013.01); *H05B 33/0809* (2013.01)

(58) Field of Classification Search
CPC ..... H05B 33/0815; H05B 33/0845; H05B 33/0884; H05B 33/0809; H05B 37/0254
USPC ..... 315/291, 200 R, 210, 294
See application file for complete search history.

(56) References Cited

U.S. PATENT DOCUMENTS

2009/0079357 A1* 3/2009 Shteynberg ..... H05B 33/0818 315/291
2011/0285311 A1* 11/2011 Yang ..... H05B 33/0827 315/291
2012/0249001 A1* 10/2012 Okubo ..... H05B 33/0851 315/200 R
2013/0082604 A1* 4/2013 Williams ..... H05B 33/0884 315/130
2014/0117868 A1* 5/2014 Lopez ..... H05B 33/0815 315/201
2014/0125241 A1* 5/2014 Elferich ..... H05B 33/0815 315/200 R (Continued)

*Primary Examiner* — Douglas W Owens
*Assistant Examiner* — Syed M Kaiser
(74) *Attorney, Agent, or Firm* — Patterson Intellectual Property Law, P.C.; Mark J. Patterson; Grant M. Ford

(57) ABSTRACT

An LED driver circuit is provided with a dynamic operating range which can be set using an offline tuning interface. During an online mode of operation, a controller for a power converter is configured to regulate the output voltage and the output current generated by the power converter based on a dimming control signal from a dimming control interface, a sensed output from the power converter, and programmed maximum output voltage and maximum output current values. During an offline mode of operation, the tuning interface may be coupled to the dimming control interface and provides a sequence of digital pulses corresponding to a desired maximum output voltage, maximum output current, or operating parameter. The controller then modifies the programmed maximum output voltage and the maximum output current values based on the predetermined sequence of digital pulses received via the tuning interface circuit.

20 Claims, 8 Drawing Sheets

(56) References Cited

U.S. PATENT DOCUMENTS

| | | | | |
|---|---|---|---|---|
| 2014/0253562 | A1* | 9/2014 | Yaras | G09G 3/342 345/501 |
| 2014/0303782 | A1* | 10/2014 | Pruchniewski | H04L 47/70 700/275 |
| 2015/0091461 | A1* | 4/2015 | Nakamura | H05B 33/0815 315/200 R |
| 2015/0180337 | A1* | 6/2015 | Ooga | H02M 3/156 315/200 R |
| 2015/0327340 | A1* | 11/2015 | Siessegger | H05B 33/0818 315/200 R |
| 2016/0299555 | A1* | 10/2016 | Rucker | G06F 1/3287 |

* cited by examiner

LED DRIVER CONFIGURATION AND DIMMING INTERFACE FOR DYNAMIC ADJUSTMENT OF DRIVER OPERATING PARAMETERS

CROSS-REFERENCES TO RELATED APPLICATIONS

This application claims benefit of U.S. Provisional Patent Application No. 62/145,266, dated Apr. 9, 2015, and which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to circuitry and methods for powering a light source such as an LED load. More particularly, the present invention relates to methods for dynamic adjustment of power parameters for LED drivers.

Light emitting diode ("LED") lighting is growing in popularity due to decreasing costs and long life compared to incandescent lighting and fluorescent lighting. LED lighting can also be dimmed without impairing the useful life of the LED light source.

LED loads are DC current driven, so a DC-DC or AC-DC converter is needed to regulate the current going through the LED to control the output power and luminance. An exemplary dimmable LED driver 10 is represented in FIG. 1. As shown, a typical four-wire output 0-10 v controllable AC-DC converter 14 is positioned between the AC mains input 12 and the LED load 16. The AC-DC converter 14 regulates the DC current going through the LED lighting module 16 and also receives control signals from dimming control block 18 to set the output current dynamically. Typically, a DC voltage 20 is provided as the input to the dimming control block 18. The dimming control block 18 will sense the voltage level 20 and set the control signal 22 for the reference of LED output current according to a preset relationship between the two values 20, 22.

The output range of the LED driver as shown in FIG. 1 typically is limited with values for a maximum output voltage (Vout_max) and maximum output current (I_out_max) as are associated with a maximum output power for the particular LED driver design. This means that there is only one maximum output current and one maximum voltage for this driver in steady state operation.

An exemplary operating range for this type of LED driver is shown in FIG. 2, wherein the operating area is limited to the highlighted region as further defined by a maximum current (I_max), minimum current (I_min) and maximum voltage (Vmax). When the output current changes the maximum output voltage would remain the same.

BRIEF SUMMARY OF THE INVENTION

One objective of the systems and methods as disclosed herein is to consolidate a series of LED drivers into a single driver that has an adjustable output. For example, it would be desirable to consolidate these five LED drivers into one single 80 W LED driver: 2 A-40V-80 W; 1.5 A-53V-80 W; 1 A-80V-80 W; 0.73 A-109V-80 W; and 0.53 A-151V-80 W. Such a design for an LED driver circuit or a light fixture incorporating such a circuit would accordingly save developing time, cost and storage room.

LED driver circuit designs as disclosed herein are provided to combine the dimming interface and LED output tuning interface so that the operating range of the LED driver could be dynamically tuned when the driver is in an offline state.

LED driver circuit designs as disclosed herein are provided to combine the dimming interface and LED output tuning interface so that the driver would have a constant power type operation range.

In one exemplary embodiment of an LED driver circuit as disclosed herein, an LED driver circuit includes a power converter, a tuning interface circuit, and a controller. The power converter is configured to generate an output voltage and an output current for driving an LED array. The tuning interface circuit is coupled to the first and second dimming input terminals during an offline mode of operation. The LED driver circuit is configured to receive both programming signals and power from the programming device via the tuning interface circuit when operating in the offline mode of operation. The programming signals include at least one of (a) a maximum voltage or maximum current value, and (b) one or more operating parameters associated with the power converter. The controller is configured to receive one or more signals from the tuning interface circuit. During the online mode of operation, an operating characteristic of the power converter is managed based at least in part upon at least one of the received programming signals. During the offline mode of operation, the controller is configured to receive at least one of the programming signals and power from the programming device.

In one embodiment, the LED driver circuit includes a dimming interface circuit configured to generate a dimming control signal based on an input received across the first and second dimming input terminals during an online mode of operation.

In a further embodiment, the dimming interface circuit includes a power supply and a buffer capacitor associated with the power supply. The tuning interface circuit includes an offline power supply circuit having a first diode having its anode connected to the second dimming input terminal and its cathode connected to at least one of the power supply and buffer capacitor associated with the power supply. A second diode has its cathode connected to the first dimming input terminal and its anode connected to ground.

In one embodiment, the LED driver circuit includes a tuning interface sensing circuit coupled to the first dimming input terminal and is configured to generate digital pulses provided to the controller, wherein the generated digital pulses correspond to digital pulses received at the tuning interface circuit from the programming device during the offline mode of operation.

The generated digital pulses correspond to at least one predetermined LED operating parameter. The at least one predetermined LED operating parameter includes information associated with at least one of a dimming curve, a dimming fading rate, and a temperature protection threshold.

The controller is configured to identify at least one of an LED operating parameter and a target maximum output voltage based on a predetermined sequence of digital pulses received via the tuning interface circuit The controller is further configured to modify at least one of the programmed maximum output current, the programmed maximum output voltage, and at least one operational LED parameter based at least in part on at least one of the identified LED operating parameter and target maximum output voltage.

Further embodiments comprise a system for tuning parameter configuration having the LED driver circuit. In another embodiment, a lighting fixture including the LED driver circuit is provided.

DETAILED DESCRIPTION OF THE INVENTION

Figure 1:
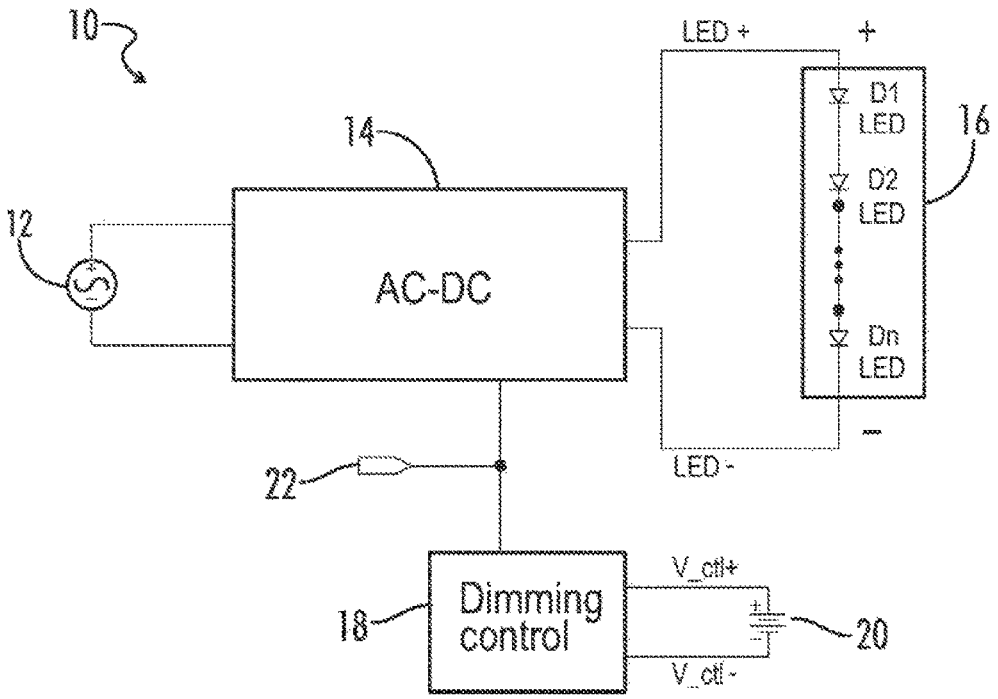
FIG. 1 (PRIOR ART)
FIG. 1 is a block diagram representing a conventional dimmable LED driver circuit.
Figure 2:
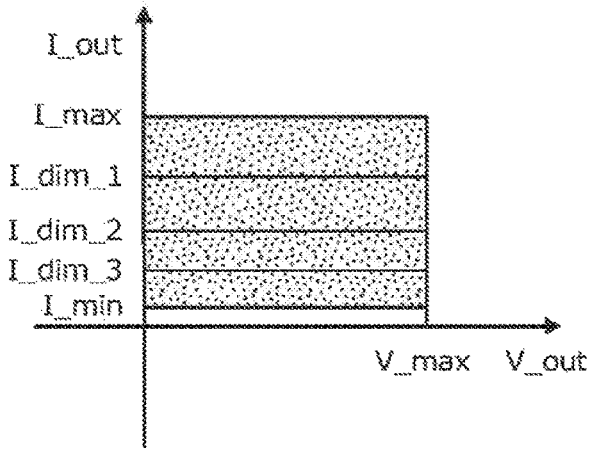
FIG. 2 is a graphical plot representing a conventional operating range for the LED driver circuit of FIG. 1.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Referring generally to FIGS. 3-10, an LED driver and associated methods according to the present disclosure are now illustrated in greater detail. Where the various figures may describe embodiments sharing various common elements and features with other embodiments, similar elements and features are given the same reference numerals and redundant description thereof may be omitted below.

Various embodiments of an LED driver according to the present invention may be designed in order to drive LED lighting elements with constant power. Embodiments of an LED driver may further be designed such that an output voltage maximum limit and/or output current maximum limit may be dynamically adjusted. The LED driver, associated circuitry and methods as presented in this disclosure further address the stated objective of consolidation, and is offline tunable without requiring the addition of any extra output wires.

Figure 3:
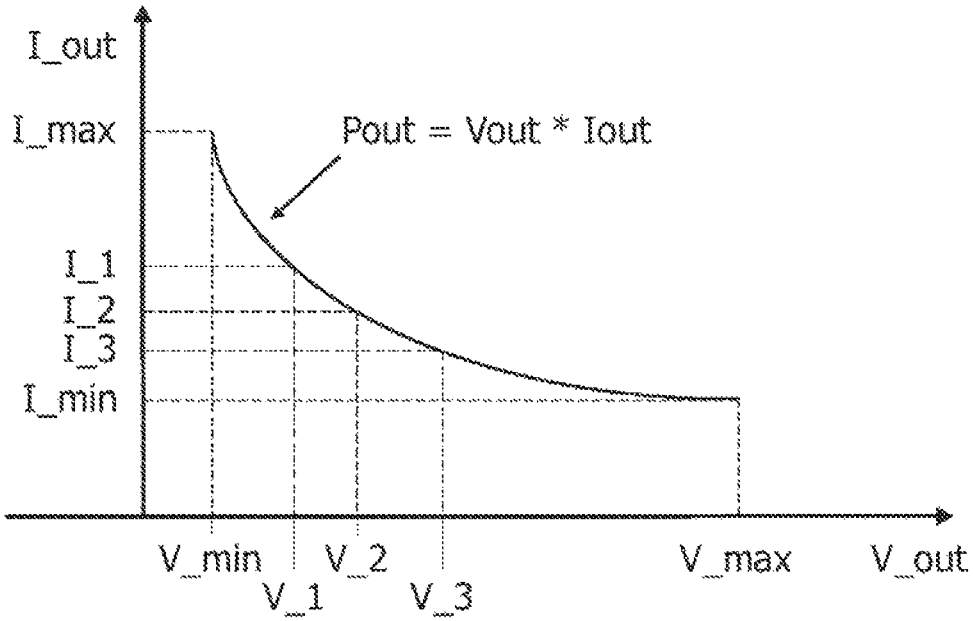
FIG. 3 is a graphical plot representing an exemplary operating range for an LED driver circuit according to the present invention.

In various exemplary embodiments, the output operating range may be controlled under a characteristic constant power curve, as represented for example in FIG. 3. The dynamic operating range will be limited by the constant power curve Pout=Vout*Tout. For each preset LED output current, there is a special operating range according to the output voltage Vout=Pout/I_out. For example: I_max & V_min; I_1 & V_1; I_2 & V_2; I_3 & V_3; and I_min & V_max.

Various embodiments consistent with the present invention may effectively solve problems and achieve goals associated with consolidation. Various embodiments may achieve offline configuration. Offline configuration may include various operating parameters, such as a dimming curve, a dimming fading rate, a maximum temperature protection threshold, etc. One or more of the operating parameters may be dynamically adjusted.

Figure 4:
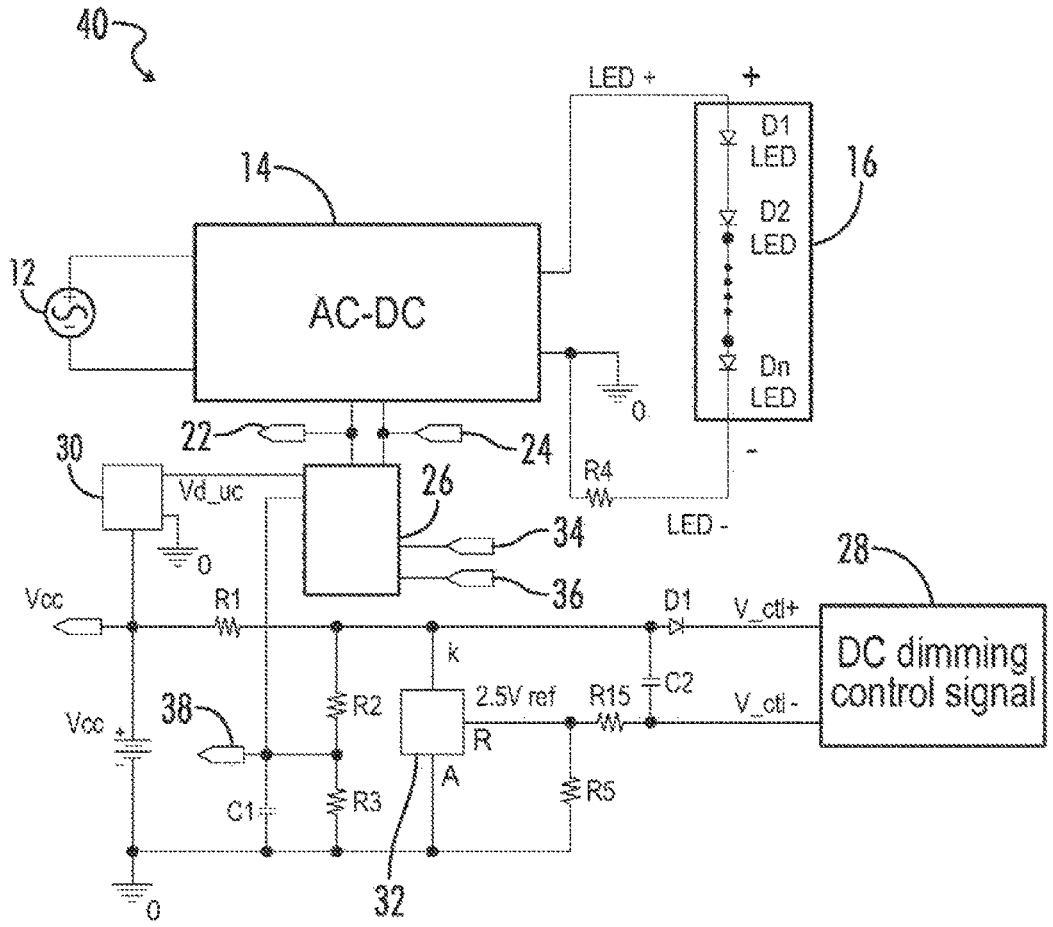
FIG. 4 is a block diagram and partial schematic diagram representing an embodiment of an LED driver according to the present invention, in online operation with dimming interface.

Referring now to FIG. 4, an LED driver 40 according to an embodiment of the present invention may first be described with respect to online (e.g., steady state) operation. As with the conventional LED driver described above, a controllable power converter 14 is provided for output current regulation. The power converter 14 can receive an LED current control signal 22 and an LED voltage control signal 24 to dynamically regulate operation of the converter and thereby the output current and voltage. The terms "power converter" and "converter" unless otherwise defined with respect to a particular element may be used interchangeably herein and with reference to at least DC-DC, DC-AC, AC-DC, buck, buck-boost, boost, half-bridge, full-bridge, H-bridge or various other forms of power conversion or inversion as known to one of skill in the art.

A controller 26 is used to sense the LED current 36, to sense the output voltage 34, and further to decode a dimming signal 38 that is provided by the dimming control interface 28 and dynamically changes the output current. The controller 26 forces the sensed LED current to be proportional to the sensed dimming control signal. The terms "controller," "control circuit" and "control circuitry" as used herein may refer to, be embodied by or otherwise included within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general purpose processor can be a microprocessor, but in the alternative, the processor can be a controller, microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

Typically a DC voltage source is connected between first and second dimming interface input terminals V_ctl+ and V_ctl−, respectively, for dimming control. The output current can be changed, via the controller 26, by adjusting the amplitude of the dimming control signal provided across the dimming interface inputs.

Figure 5:
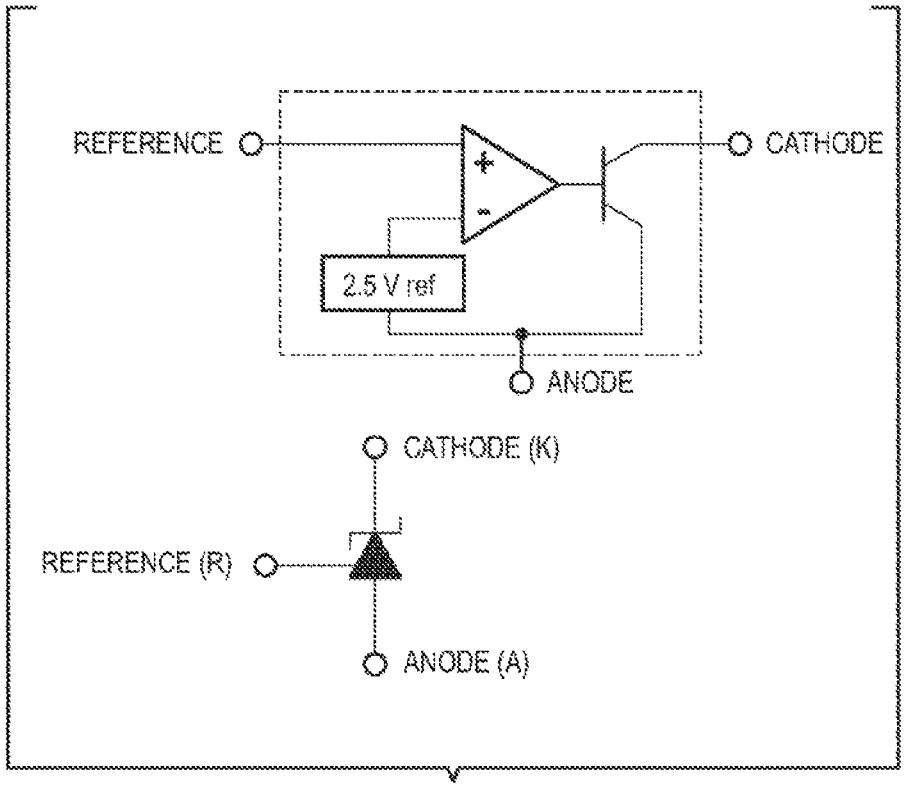
FIG. 5 is a block diagram representing exemplary internal circuitry for a dimming controller in the LED driver of FIG. 4.

In an embodiment, a programmable shunt regulator (such as a TL431) is provided as a dimming controller 32. An exemplary internal block diagram for the TL431 regulator is represented in FIG. 5. The "A" terminal is the ground reference, terminal "K" is the input of the regulator, and "R" is the reference voltage terminal. A resistance R5 (FIG. 4) may be coupled between terminals R and A to set the maximum output current that is allowed through V_ctl+ and V_ctl−. The maximum current is defined by 2.5V/R5.

The dimming control principle may now be described with further reference to FIG. 4. A voltage regulator 30 is used to supply the controller 26 with voltage from power source Vcc. A capacitor C2 is coupled across the dimming interface input terminals V_ctl+ and V_ctl− to filter out high frequency noise. A diode D1 is provided along the positive input terminal V_ctl+ to force the direction of the current and block the negative voltage across the dimming interface input terminals. A resistance R1 is provided to limit the current going into the TL431 regulator 32. Resistor R15 is used to decouple the circuit ground from the negative dimming interface terminal Vctl−. Resistors R2 and R3 form a voltage divider to sense the dimming signal that is controlled by the voltage across V_ctl+ and V_ctl− (i.e., V_ctl). The voltage across R2 and R3 is defined by:

$$V_r2_r3=0.7\text{V}+2.5\text{V}*(1+R15/R5)+V_ctl.$$

The dimming output signal 38 voltage (V_dim_sense) may thus be determined as follows:

$$V_\text{dim_sense}=(0.7\text{V}+2.5\text{V}*(1+R15/R5)+V_ctl)*R3/(R2+R3).$$

As a result, the dimming output signal will be linearly proportional with respect to the dimming control voltage V_ctl which may be provided, for example, from an external source via the interface 28.

The controller 26 senses the dimming control signal and regulates or adjusts the LED current output dynamically by modifying current control signal 22 and forcing the current control signal 22 to be equal to the sensed current signal 36.

An exemplary embodiment of an offline tuning principle is described with reference to FIG. 6. The LED driver of FIG. 4 is now represented in an offline context as 60, although no extra wiring has been added to obtain the offline tuning functions as further described herein.

A tuning programmer 62 is provided to implement the tuning function. A first tuning input (+) and a second tuning input (−) are applied between the respective first and second dimming interface inputs V_ctl+ and V_ctl−. The tuning+ and tuning− signals are communicated to a tuning input circuit 72. The tuning input circuit 72 includes a diode D10 having an anode connected to V_ctl+ (tuning+) and a cathode connected to Vcc. The tuning input circuit 72 further includes a diode D11 having its cathode connected to V_ctl− (tuning−) and its anode connected to ground. In one exemplary embodiment, the tuning input circuit 72 operates as an offline power supply circuit to supply power to the controller 26 and dimming interface when the LED driver circuit operates in an offline mode.

A tuning program sensing circuit 70 is coupled via capacitor C3 to the second dimming interface terminal V_ctl+. The capacitor C3 senses a transient change in voltage over time dv/dt to charge or discharge the gate-source capacitor C4 and subsequently turn on or turn off a switching element Q1 coupled thereto. The terms "switching element" and "switch" may be used interchangeably and may refer herein to at least: a variety of transistors as known in the art (including but not limited to FET, BJT, IGBT, JFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

Figure 6:
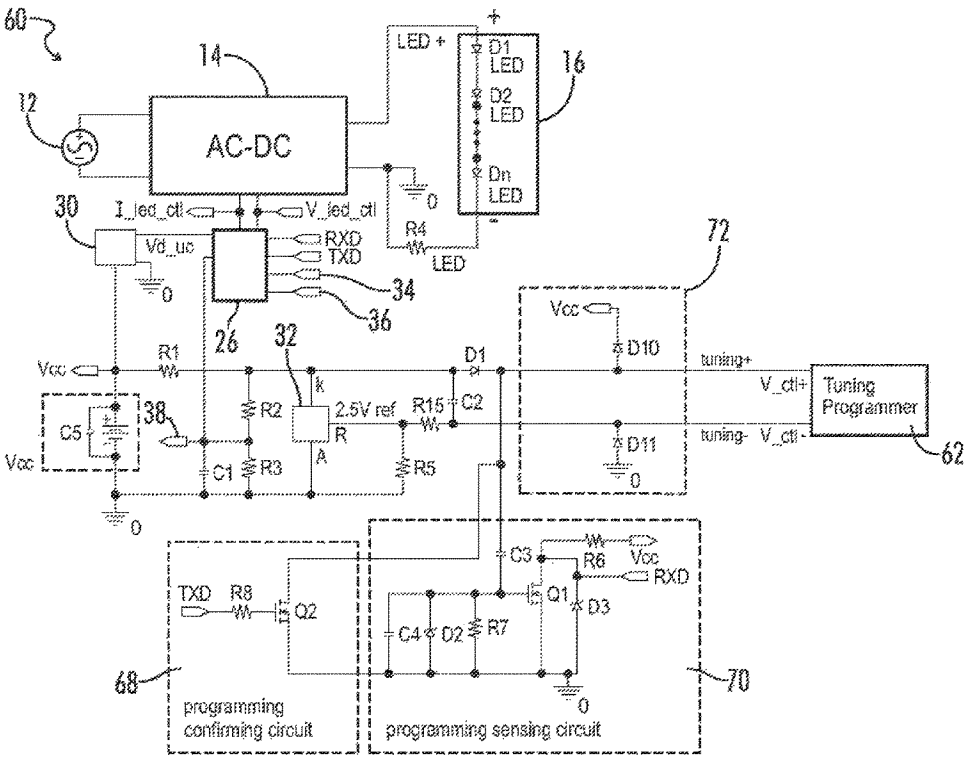
FIG. 6 is a block diagram and partial schematic diagram representing an embodiment of the LED driver of FIG. 4, in offline operation with tuning interface and circuitry applied.

In embodiments as shown in FIG. 6, diode D2 is coupled in parallel with the gate-source capacitor C4 to limit the voltage across capacitor C4. Resistor R7 is also coupled in parallel with diode D2 for noise suppression. Resistor R6 is coupled between a supply voltage Vcc and the drain terminal of switching element Q1, such that when switching element Q1 is off, the voltage at digital signal output RXD is a "high" voltage (equivalent to digital "1") that is limited by diode D3. When the switching element Q1 is on, the voltage at digital signal output RXD is a "low" voltage (equivalent to digital "0").

When the tuning programmer 62 is implemented to reset the maximum current and voltage values, a series of digital pulses is generated by the programmer via the tuning programmer outputs (+) and (−) across the V_ctl+ and the negative dimming interface terminal V_ctl−. One or more of the series of digital pulses charge a capacitor C5 associated with Vcc. The capacitor C5 operates as a Vcc buffer capacitor through diodes D10 and D11. The programming sensing circuit 70 generates a serial message in the form of series RXD signals and feeds the signals back to the controller 26 for modification of the maximum output voltage and current settings (as applicable). In this arrangement, power may be provided to the dimming interface circuit by a programming device, such as tuning programmer 62, via the tuning input circuit 72 when the LED driver circuit is operating in an offline mode. In one exemplary embodiment, an offline power supply power charging path may progress from the tuning programmer 62 across diode D10 to buffer capacitor C5, across diode D11, then to the tuning programmer 62. Accordingly, in one exemplary embodiment, power sufficient for controller 26 to operate may be provided by the tuning programmer 62 such that operational characteristics of the LED driver circuit may be modified as described herein when the LED driver circuit operates in an offline mode.

Figure 7:
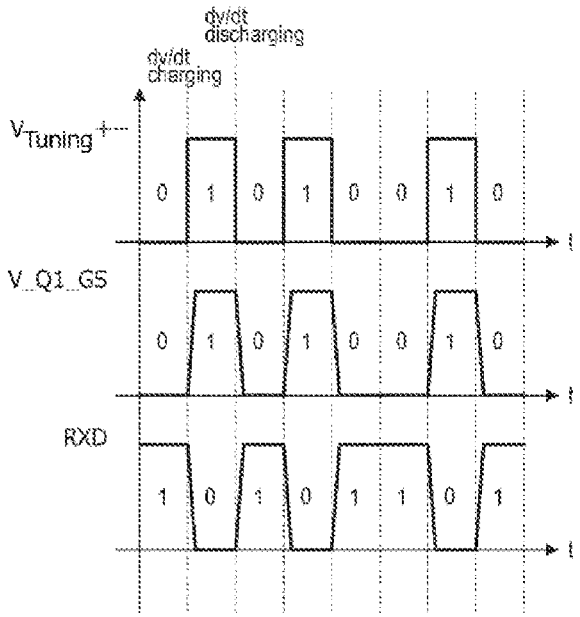
FIG. 7 is a graphical plot representing an exemplary working principle of a tuning interface sensing circuit according to the LED driver of FIG. 6.

Further illustration of this operation is provided with reference now to FIG. 7. When the tuning programmer 62 is implemented to reset the maximum output voltage and maximum output current values, a series of high (1) and low (0) digital pulse will be sent out across positive dimming interface terminal V_ctl+ and the negative dimming interface terminal V_ctl−. As the tuning input signal Tuning+− (also referred to herein as Vtuning+− or Vtuning) changes from low (0) to high (1), a positive transient dv/dt takes place. The capacitor C3 senses this positive transient dv/dt to a charging current through the gate electrode to the source electrode of switching element Q1, charging up the gate-source capacitor C4 as a result. A gate-source voltage for the switching element Q1 is charged up to high and turns on the switching element Q1. As a result, the digital signal output RXD will be low (0) after the 0-1 transient. After the tuning input signal (Tuning+−, i.e., Vtuning) changes to high (1), it will stay steady at high (1) for a short period of time.

Because there is no transient dv/dt when the control voltage is stable, there is no current that charges or discharges the gate-source voltage of the switching element Q1. Therefore the gate-source voltage V_Q1_GS of the switching element Q1 will stay high after the 0-1 transient of tuning input pulse signal Tuning+−.

When the next transient occurs, the tuning input pulse signal Vtuning+− (i.e., Tuning+−) changes from high (1) to low (0), which introduces a detectable negative transient dv/dt at the capacitor C3 and discharges the gate-source capacitor C4 to zero. The gate-source voltage V_Q1_GS of the switching element Q1 will remain low (0) when the tuning input signal Vtuning+− remains low (0). As a result, the digital signal output RXD will be exactly reversed as compared to the tuning input pulse signal Vtuning+−. The controller 26 will accordingly sense the digital signal RXD, and in various embodiments may be configured to perform a logic inverse to obtain exactly the same signal as the tuning input pulse signal Vtuning. Where specific signal sequences have been pre-defined, the controller 26 can use the defined sequences to modify the internal memory and reset the output current and voltage limit dynamically.

Information other than power level, such as dimming rate, dimming curve, maximum temperature protection point, etc. may be programmed at or by the controller 26 during an offline state by using one or more programming pulse sequences. For example, in one embodiment, the controller 26 stores and/or recognizes one or more operating parameter settings based on a predetermined pulse sequence.

Figure 8:
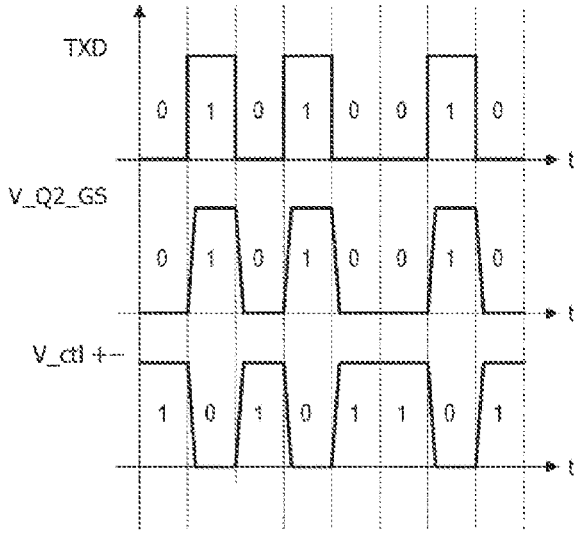
FIG. 8 is a graphical plot representing an exemplary working principle of a tuning confirmation circuit according to the LED driver of FIG. 6.

Referring now to FIGS. 6 and 8, a tuning confirmation principle may now be described with respect to various embodiments of a driver as disclosed herein. It is desirable for many applications to test the programming after the controller 26 adjusts the maximum output current and maximum output voltage values to confirm whether the programming was successful or not. A programming confirmation circuit 68 as disclosed in FIG. 6 includes a switching element Q2 connected between circuit ground and the positive dimming interface terminal V_ctl+. A digital signal input TXD is coupled between the controller 26 and the gate terminal of the switching element Q2. If the switching element Q2 is turned on by the TXD signal, the positive dimming interface terminal V_ctl+ will be shorted to circuit ground. If the switching element Q2 is off, the positive dimming interface terminal V_ctl+ will be pulled high. The digital signal TXD is an internal confirmation signal sent out by the controller 26 to the programming confirmation circuit 68 to generate a confirmation signal in the form of the positive dimming interface terminal V_ctl+ being pulled low, which can be picked up by the tuning programmer 62 to be used to confirm the success of the programming steps (or lack thereof).

Operation of the programming confirmation circuit 68 may be further described with reference to FIG. 8. As previously noted, when the digital input signal TXD is low (0), the gate-source voltage V_Q2_GS for the switching element Q2 is also low, wherein the switching element Q2 is turned off and the positive dimming interface terminal V_ctl+ is pulled high. Likewise, when the digital input signal TXD is high (1), the gate-source voltage V_Q2_GS for the switching element Q2 is also high, wherein the switching element Q2 is turned on and the positive dimming interface terminal V_ctl+ is shorted to circuit ground, i.e., pulled low.

Figure 9:
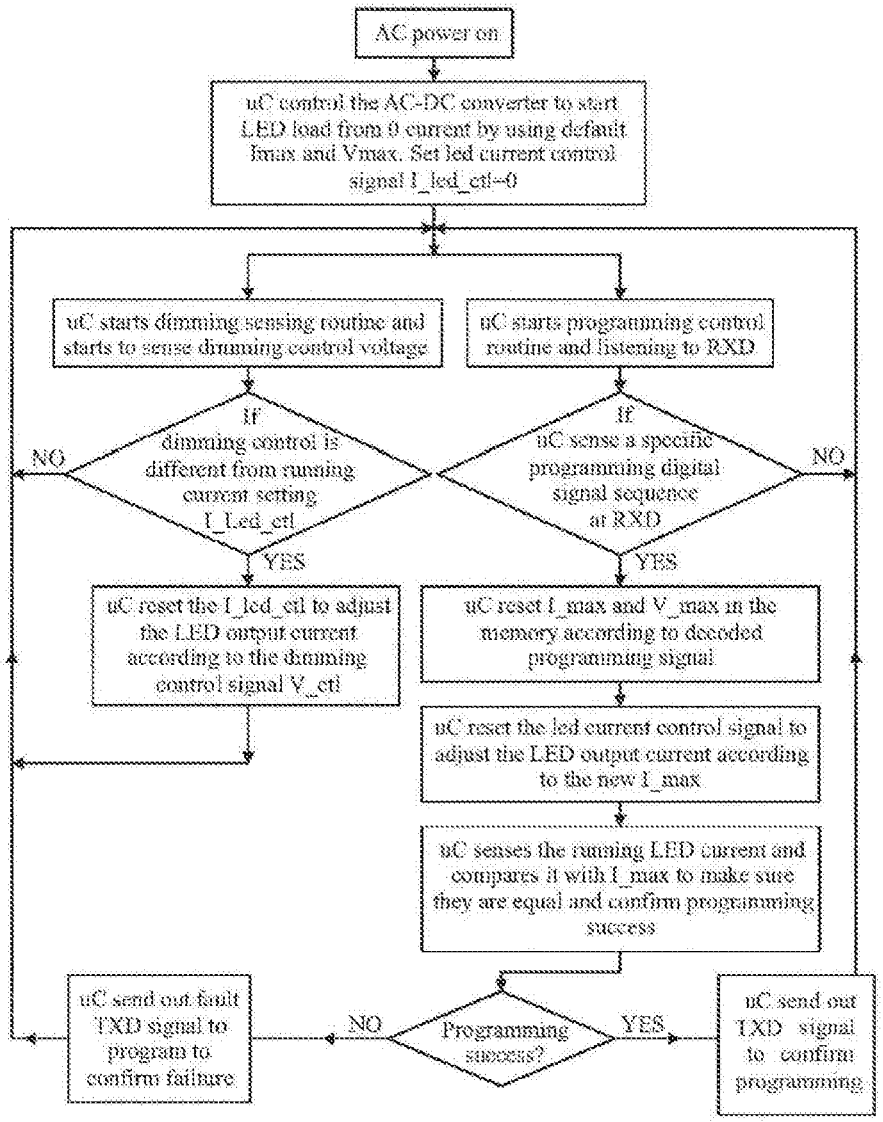
FIG. 9 is a flowchart representing an exemplary control method according to aspects of the present invention.

With further reference to FIG. 9, if programming has been successful, a series of digital signals (e.g., the same as the programming signal(s) received by the controller 26) can be sent out by the controller via RXD to generate a confirmation signal on V_ctl+ which is again reversed as compared to TXD. The tuning programmer 62 can reverse the confirmation signal and compare it with the programming signal to confirm if programming is successful or not. In various embodiments, the tuning programmer may be provided with a green light which will show up on the programmer to indicate successful programming, or otherwise a red light may be used to indicate programming failure.

Figure 10:
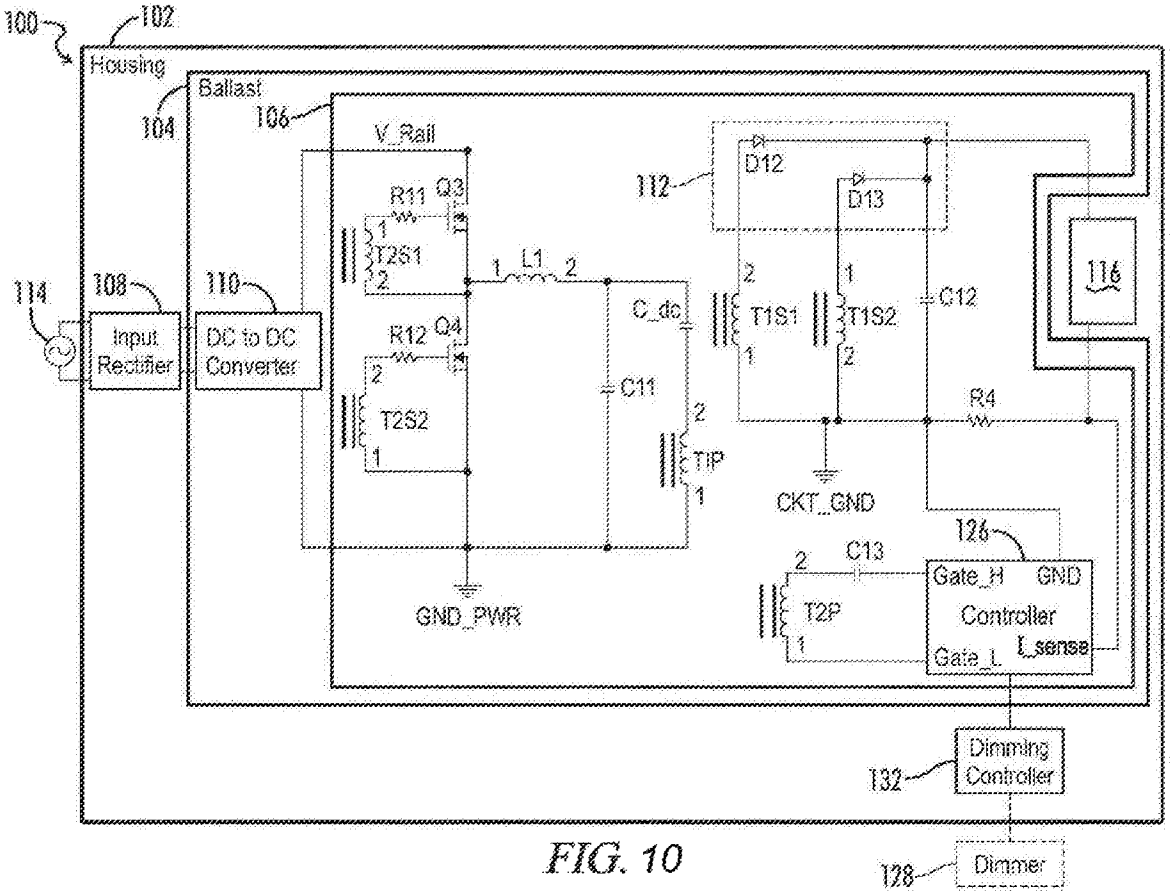
FIG. 10 is a block diagram and partial schematic diagram representing an embodiment of a light fixture having an LED driver according to aspects of the present invention.

FIG. 10 further illustrates an example of a light fixture 100 with an embodiment of the LED driver as disclosed herein. While FIG. 10 may provide a more detailed recitation of an exemplary power converter, for example, with respect to exemplary LED drivers, the description provided below is not intended as limiting in any way on the scope of the present invention.

The exemplary light fixture 100 includes a housing 102, a ballast 106, and an LED array 116 as a light source. The light fixture 100 receives power from an alternating current (AC) power source 114 and provides current to the LED array 116. The housing 102 is coupled to the ballast 106 and the light source 116, and in one embodiment may support the ballast 106 and the light source 116 in a predetermined spatial relationship. The light fixture 100 also includes a dimming circuit 132 to provide a dimming signal to the controller 126 which is indicative of a target current or light intensity level for the light source 116.

The ballast 106 includes an input rectifier 108 and a driver circuit 104. The input rectifier 108 connects to the AC power source 114 and provides a DC power source having a power rail V_RAIL and a ground GND_PWR at an output of the input rectifier 108. In one embodiment, the ballast 106 also includes a DC-to-DC converter 110 connected between the input rectifier 108 and the driver circuit 104. The DC-to-DC converter 110 alters a voltage of a power rail V_RAIL of a DC power source provided by the input rectifier 108. The driver circuit 104 provides current to the light source 116 from the DC power source provided by the input rectifier 108.

The driver circuit 104 includes a half-bridge inverter, a resonant tank circuit, an isolating transformer T1, an output rectifier 112, and the controller 120. The half-bridge inverter includes a first switch Q3 (i.e., a high side switch) and a second switch Q4 (i.e., a low side switch) and has an input connected to the power rail V_RAIL and the ground PWR_GND of the DC power source, and an AC signal output. In one embodiment, the input of the half-bridge inverter is a high side of the high side switch, and a low side of the low side switch (e.g., second switch Q4) connects to the ground of the DC power source.

The resonant tank circuit includes at least a resonant inductor L1 and a resonant capacitor C11. An input of the resonant tank circuit (e.g., a first terminal of a resonant inductor L1) is connected to the output of the half-bridge inverter. The resonant capacitor C11 is connected in series with the resonant inductor L1 between the output of the half-bridge inverter and the ground GND_PWR of the DC power source. In one embodiment, the resonant tank circuit includes a DC blocking capacitor C_DC connected between the junction of the resonant inductor L1 and resonant capacitor C11 and the output of the resonant tank circuit.

An isolating transformer is connected to the output of the resonant tank circuit. The isolating transformer includes a primary winding T1P and a secondary winding T1S1, T1S2. The primary winding T1P is connected between the output of the resonant tank circuit and the ground PWR_GND of the DC power source. The output rectifier 112 has an input connected to the secondary winding T1S1, T1S2 of the isolating transformer and an output connected to the light source 116. In one embodiment, the turns ratio of the isolating transformer is selected as a function of a voltage of the power rail V_RAIL of the DC power source and a predetermined output voltage limit. In one embodiment, the output voltage limit is 60 VDC.

In one embodiment, the secondary winding T1S1, T1S2 of the isolating transformer is connected to a circuit ground CKT_GND which is isolated from the ground PWR_GND of the DC power source by the isolating transformer. Specifically, the secondary winding includes first secondary winding T1S1 and second secondary winding T1S2, each connected to the circuit ground CKT_GND. The first secondary winding T1S1 and the second secondary winding T1S2 are connected out of phase with one another.

The output rectifier includes a first output diode D12 and a second output diode D13. The first output diode D12 has its anode connected to the first secondary winding T1S1 and a cathode coupled to the light source 116 (i.e., an output of the driver circuit 104 and ballast 106). The second output diode D13 has an anode connected to the second secondary winding T1S2 and a cathode coupled to the light source 116 (i.e., the output of the driver circuit 104 and ballast 106).

In one embodiment, an output capacitor C12 is connected between the output of the output rectifier 112 and the circuit ground CKT_GND to smooth or stabilize the output voltage of the driver circuit 104 and ballast 106. In one embodiment, a current sensing resistor R4 is connected between the circuit ground CKT_GND and the light source 116. A first terminal of the current sensing resistor R4 is connected to the circuit ground CKT_GND, and a second terminal of the current sensing resistor is connected to the light source 116. Thus, a voltage across the current sensing resistor R4 is proportional to a current through the light source 116. The controller 126 is connected to the circuit ground CKT_GND and the second terminal of the current sensing resistor R4 to monitor the voltage across the current sensing resistor and sense the current provided to the light source 116 by the ballast 106.

In one embodiment, the driver circuit 104 further includes a gate drive transformer. The gate drive transformer receives the gate drive signal from the controller 126 which controls the switching frequency of the half-bridge inverter. The gate drive transformer includes a primary winding T2P a first secondary winding T2S1, and a second secondary winding T2S2. In this embodiment, the first switch Q3 and the second switch Q4 of the half-bridge inverter each have a high terminal, a low terminal, and a control terminal. The high terminal of the first switch Q3 is connected to the power rail V_RAIL of the DC power source. The low terminal of the second switch Q4 is connected to the ground PWR_GND of the DC power source. The high terminal of the second switch Q4 is connected to the low terminal of the first switch Q3. A gate drive capacitor C13 is connected in series with the primary winding T2P of the gate drive transformer across a gate drive output (i.e., gate_H and gate_L) of the controller 126. A first gate drive resistor R11 is connected in series with the first secondary winding T2S1 of the gate drive transformer between the control terminal of the first switch Q3 and the output of the half-bridge inverter. A second gate drive resistor R12 is connected in series with the second secondary winding T2S2 of the gate drive transformer between the control terminal of the second switch Q4 and the ground PWR_GND of the DC power circuit. The polarities of the first secondary winding T2S1 and the second secondary winding T2S2 of the gate drive transformer are opposed such that the first switch Q3 and the second switch Q4 are driven out of phase by the gate drive transformer.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

The term "circuit" means at least either a single component or a multiplicity of components, either active and/or passive, that are coupled together to provide a desired function. Terms such as "wire," "wiring," "line," "signal," "conductor," and "bus" may be used to refer to any known structure, construction, arrangement, technique, method and/or process for physically transferring a signal from one point in a circuit to another. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. An LED driver circuit having first and second dimming interface input terminals, the LED driver circuit comprising:

a power converter configured to generate an output voltage and an output current for driving an LED array;

a tuning interface circuit coupled to the first and second dimming interface input terminals during an offline mode of operation, wherein (i) the LED driver circuit is configured to receive both programming signals and power from a programming device via the tuning interface circuit when operating in the offline mode of operation, and wherein (ii) the programming signals comprise at least one of (a) a maximum voltage or maximum current value, and (b) one or more operating parameters associated with the power converter;

a controller configured to receive one or more signals from the tuning interface circuit, the controller being configured such that (i) during an online mode of operation an operating characteristic of the power converter is managed based at least in part upon at least one of the received programming signals, and (ii) during the offline mode of operation to receive at least one of the programming signals and power from the programming device.

2. The LED driver circuit of claim 1, wherein the LED driver circuit further comprises a dimming interface circuit configured to generate a dimming control signal based on an input received across the first and second dimming interface input terminals during the online mode of operation.

3. The LED driver circuit of claim 1, wherein the dimming interface circuit comprises a power supply and a buffer capacitor associated with the power supply.

4. The LED driver circuit of claim 3, wherein the tuning interface circuit comprises an offline power supply circuit, the offline power supply circuit comprising:

a first diode having its anode connected to the second dimming interface input terminal and its cathode connected to at least one of the power supply and buffer capacitor associated with the power supply; and a second diode having its cathode connected to the first dimming interface input terminal and its anode connected to ground.

5. The LED driver circuit of claim 1, further comprising:

a tuning interface sensing circuit coupled to the first dimming interface input terminal and configured to generate digital pulses provided to the controller, wherein the generated digital pulses correspond to digital pulses received at the tuning interface circuit from the programming device during the offline mode of operation.

6. The LED driver circuit of claim 5, wherein the generated digital pulses correspond to at least one predetermined LED operating parameter.

7. The LED driver circuit of claim 6, wherein the at least one predetermined LED operating parameter comprises information associated with at least one of a dimming curve, a dimming fading rate, and a temperature protection threshold.

8. The LED driver circuit of claim 1, wherein the controller is configured to identify at least one of an LED operating parameter and a target maximum output voltage based on a predetermined sequence of digital pulses received via the tuning interface circuit, and is further configured to modify at least one of the programmed maximum output current, the programmed maximum output voltage, and at least one operational LED parameter based at least in part on at least one of the identified LED operating parameter and target maximum output voltage.

9. A system for tuning parameter configuration of an LED driver circuit when the LED driver circuit operates in an offline mode of operation, the system comprising:

a conductive bus;

a programming device configured to output at least one of programming signals and power to the LED driver circuit via the conductive bus; and an LED driver circuit, the LED driver circuit comprising a power converter configured to generate an output voltage and an output current for driving an LED array, a tuning interface circuit coupled to the programming device via the conductive bus during the offline mode of operation, wherein the LED driver circuit is configured to receive both programming signals and power from the programming device when operating in the offline mode of operation, and a controller configured to receive one or more signals from the tuning interface circuit, the controller being configured such that (i) during an online mode of operation an operating characteristic of the power converter is managed based at least in part upon at least one of the received programming signals.

10. The system of claim 9, wherein the LED driver circuit further comprises a dimming interface circuit configured to generate a dimming control signal based on an input received by the dimming interface circuit during the online mode of operation.

11. The system of claim 9, wherein the dimming interface circuit comprises a power supply and a buffer capacitor associated with the power supply; and wherein the tuning interface circuit comprises an offline power supply circuit, the offline power supply circuit comprising:

a first diode having its anode connected to the second dimming interface input terminal and its cathode connected to at least one of the power supply and buffer capacitor associated with the power supply; and a second diode having its cathode connected to the first dimming interface input terminal and its anode connected to ground.

12. The system of claim 9, wherein the programming signals are configured to correspond to at least one predetermined LED operating parameter.

13. The system of claim 12, wherein the at least one predetermined LED operating parameter comprises information associated with at least one of a dimming curve, a dimming fading rate, and a temperature protection threshold.

14. The system of claim 9, wherein the controller is configured to identify at least one of an LED operating parameter and a target maximum output voltage based on a predetermined sequence of digital pulses received via the tuning interface circuit, and is further configured to modify at least one of the programmed maximum output current, the programmed maximum output voltage, and at least one operational LED parameter based at least in part on at least one of the identified LED operating parameter and target maximum output voltage.

15. The system of claim 12, wherein the conductive bus comprises a plurality of conductive lines, and wherein transmitting at least one tuning signal from the programming device comprises modifying a voltage associated with at least one of the plurality of conductive lines.

16. The system of claim 15, wherein the shared bus comprises two conductive lines associated with a control voltage provided by the programming device, and wherein transmitting at least one tuning signal from the programming device comprises transmitting the control voltage across the two conductive lines.

17. A lighting fixture configured to connect to a programming device for offline tuning parameter configuration when the lighting fixture operates in an offline mode of operation, the lighting fixture comprising:

a housing;

an array of light emitting diodes (LEDs) connected to the housing; and an LED driver circuit connected to the housing, the LED driver circuit comprising a power converter configured to generate an output voltage and an output current for driving the LED array, a dimming interface circuit configured to generate a dimming control signal based on an input received across first and second dimming interface input terminals during an online mode of operation, a tuning interface circuit configured to couple to the first and second dimming interface input terminals during the offline mode of operation, wherein the LED driver circuit is configured to receive both programming signals and power from the programming device at the tuning interface circuit when operating in the offline mode of operation, and a controller configured (i) during the online mode of operation to regulate the output voltage and the output current generated by the power converter, and (ii) during the offline mode of operation to operate using at least one of the programming signals and power received from the programming device.

18. The lighting fixture of claim 17, wherein the LED driver circuit further comprises a dimming interface circuit configured to generate a dimming control signal based on an input received by the dimming interface circuit during the online mode of operation.

19. The lighting fixture of claim 17, wherein the dimming interface circuit comprises a power supply and a buffer capacitor associated with the power supply; and wherein the tuning interface circuit comprises an offline power supply circuit, the offline power supply circuit comprising a first diode having its anode connected to the second dimming interface input terminal and its cathode connected to at least one of the power supply and buffer capacitor associated with the power supply, and a second diode having its cathode connected to the first dimming interface input terminal and its anode connected to ground.

20. The lighting fixture of claim 17, wherein the controller is configured to identify at least one of an LED operating parameter and a target maximum output voltage based on a predetermined sequence of digital pulses received via the tuning interface circuit, and is further configured to modify at least one of the programmed maximum output current, the programmed maximum output voltage, and at least one operational LED parameter based at least in part on at least one of the identified LED operating parameter and target maximum output voltage.

* * * * *